US006315532B1

(12) United States Patent
Appleby

(10) Patent No.: US 6,315,532 B1
(45) Date of Patent: Nov. 13, 2001

(54) DUAL DISC PUMP

(75) Inventor: Derek Appleby, Eastbourne (GB)

(73) Assignee: Alfa Laval Pumps Ltd., Sussex (GB)

( * ) Notice: Subject to any disclaimer, the term of this patent is extended or adjusted under 35 U.S.C. 154(b) by 0 days.

(21) Appl. No.: 09/508,938

(22) PCT Filed: Sep. 14, 1998

(86) PCT No.: PCT/GB98/02776

§ 371 Date: Jun. 12, 2000

§ 102(e) Date: Jun. 12, 2000

(87) PCT Pub. No.: WO99/14495

PCT Pub. Date: Mar. 25, 1999

(30) Foreign Application Priority Data

Sep. 17, 1997 (GB) ..... 9719828

(51) Int. Cl.[7] ..... F04B 7/00; F04B 11/00
(52) U.S. Cl. ..... 417/510; 417/539
(58) Field of Search ..... 417/510, 515, 417/520, 539

(56) References Cited

U.S. PATENT DOCUMENTS

| | | | | |
|---|---|---|---|---|
| 4,473,339 | | 9/1984 | Hughes | 417/240 |
| 5,529,466 | * | 6/1996 | Tackett | 417/529 |
| 5,733,105 | * | 3/1998 | Beckett et al. | 417/516 |
| 5,993,174 | * | 11/1999 | Konishi | 417/521 |
| 6,200,111 | * | 3/2001 | Foss | 417/515 |

FOREIGN PATENT DOCUMENTS

| | | |
|---|---|---|
| 539247 | 9/1941 | (GB) . |
| 1399742 | 7/1975 | (GB) . |
| 2013287 | 8/1979 | (GB) . |

* cited by examiner

*Primary Examiner*—Timothy S. Thorpe
*Assistant Examiner*—Michael K. Gray
(74) *Attorney, Agent, or Firm*—Hovey, Williams, Timmons & Collins

(57) ABSTRACT

A dual disc pump in which the suction disc is phased to lag by more than 180° behind the pressure disc.

5 Claims, 3 Drawing Sheets

DUAL DISC PUMP

BACKGROUND OF THE INVENTION

1. Field of the Invention

The present invention relates to a dual disc pump.

2. Description of the Prior Art

Double disc pumps comprise a housing having a pumping chamber therein, an inlet and an outlet to the pumping chamber, first and second seats formed in said pumping chamber at spaced locations, a suction pumping disc reciprocable into and out of engagement with said first seat, a pressure pumping disc reciprocable into and out of engagement with said second seat and means to reciprocate said pumping disc out of phase with one another.

In traditional double disc pumps the pump is essentially glandless and gives indefinite dry running ability, combined with good self-priming and solids handling. These pumps are ideal for medium flow sludge transfer duties and are widely used on unmanned primary sewerage treatment works. A double disc pump eliminates the need for shaft sealing and valve problems inherent in other types of pumps. In addition to sludge transfer, these pumps can handle liquids, slurries, large suspended solids, thixotropic media and liquid/gas mixtures.

While such double disc pumps have proved to be generally satisfactory there is room for improvement.

SUMMARY OF THE INVENTION

According to the present invention, the suction disc is phased to lag by more than 180° behind the pressure disc.

The applicants have found that, as compared with conventional pumps in which the suction disc is phased to lag by exactly 180° behind the pressure disc, certain advantages arise.

Firstly, there can be a very marked reduction in the noise of the pump.

Secondly, there can be a worthwhile improvement in the efficiency of the pump, producing a higher flow rate. This combination of improvements is highly surprising and is contrary to normal pump technology experience.

In a preferred construction according to the invention the suction disc is phased to lag by between 190° and 225°, and preferably by between 205° and 215° behind the pressure disc.

In particular if the latter parameters are chosen, experiments have shown that, in one particular construction, the noise level of the pump, operating perfectly normally, can be reduced from about 85 dBA and the flow rate can be increased from about 45 $m^3$/hr to about 48 $m^3$/hr.

BRIEF DESCRIPTION OF THE DRAWINGS

In order that the present invention may more readily be understood, the following is given, merely by way of example, reference being made to the accompanying drawings in which.

DESCRIPTION OF THE PREFERRED EMBODIMENT

Figure 1:
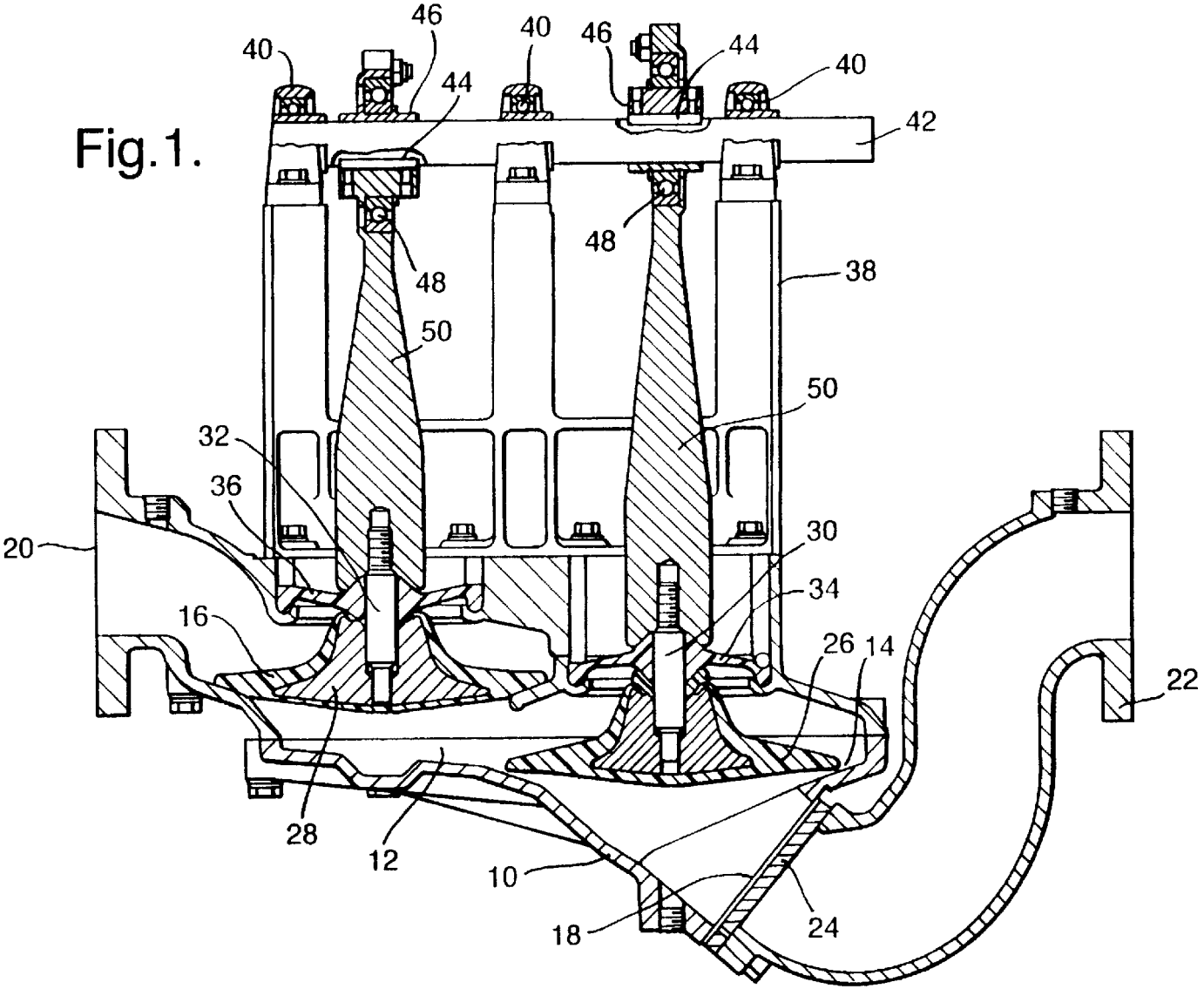
FIG. 1 is a cross-section through one embodiment of pump of the type to which the present invention applies.

Referring first to FIG. 1, the pump illustrated comprises a housing 10 within which is formed a pumping chamber 12 formed with a first seat 14 and second seat 16 which are located at spaced locations within the pumping chamber 12. The pumping chamber includes an inlet 18 and an outlet 20, the inlet 18 having a suction pipe 22 secured thereto with the intermediary of a flap valve 24.

Reciprocable within the housing is a suction disc 26 engageable with the first seat 14 and a pressure disc 28 engageable with the second seat 16. Discs 26 and 28 are screwed onto drive pins 30 and 32 respectively, these pins passing through diaphragm seals 34 and 36, the outer beads of which are clamped within the upper part of the housing 10.

It will be noted that the upper part 38 has rotatable mounted in bearings 40 a drive shaft 42 to which are keyed, as by keys 44, collars 46 which are eccentrically mounted on the shaft 42 out of phase with one another. Surrounding the collars 46 are bearings 48 which rotate relative to drive rods 50 into which are screwed the drive pins 30, 32.

It will be noted that the diaphragms 34, 36 have frusto conical centre portions, facing upwardly and downwardly, these portions surrounding the drive pins 30, 32 so that when the drive pins 30, 32 are screwed into the drive rods 50, the diaphragms are compressed against the drive pins thereby providing a complete seal.

In the conventional disc pump of this type, the keys and keyways 44 are exactly 180° offset one with respect to the other so that the suction disc 26 and the pressure disc 28 move at exactly 180° out of phase.

Figure 2:
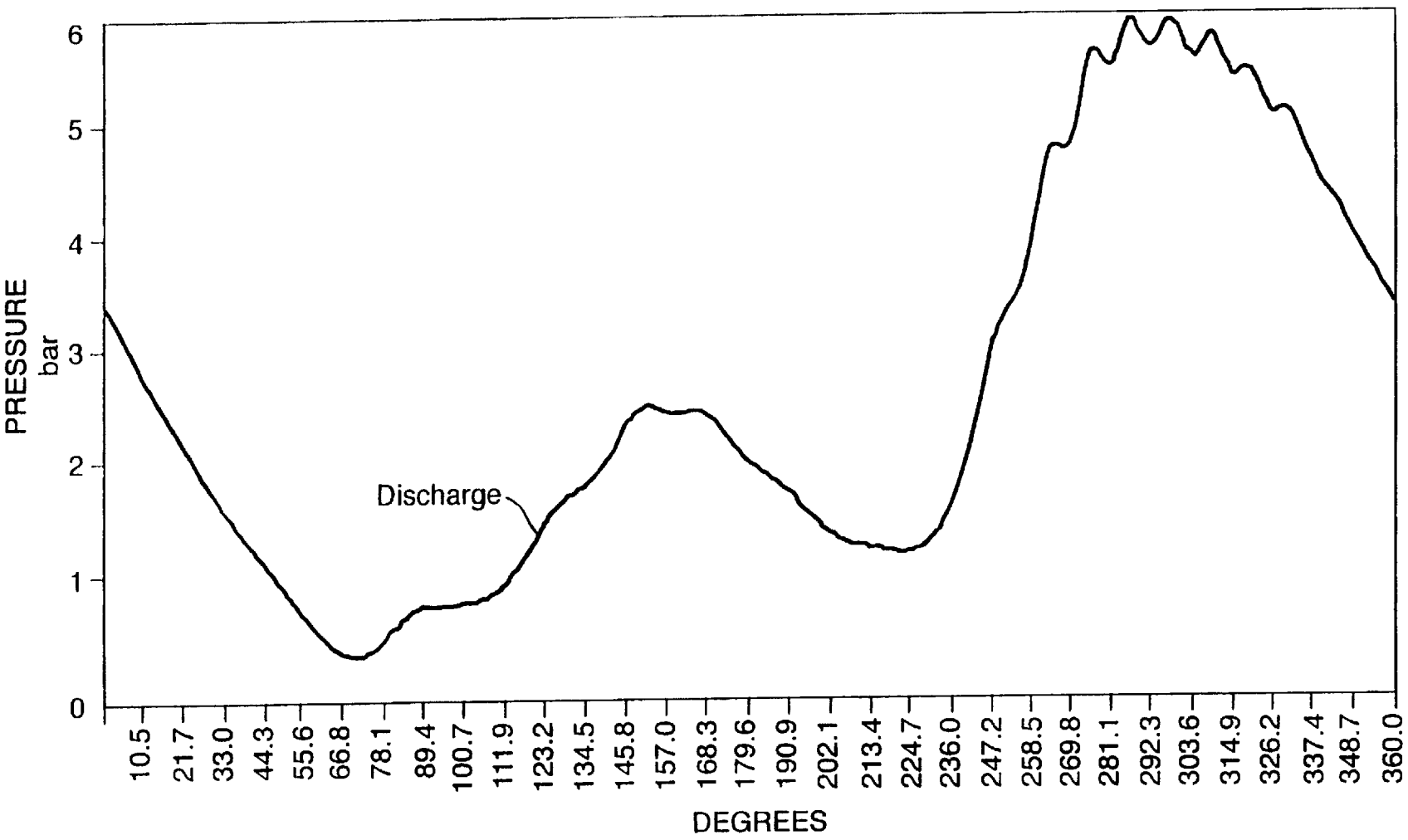
FIG. 2 is a graph showing a pressure analysis of a standard pump.

While this is generally satisfactory, it produces rather erratic pressure pulses as demonstrated in FIG. 2 and this produces a rather considerable amount of noise.

According to the present invention, the reciprocation of the suction disc is arranged to be lagging the reciprocation of the pressure disc by more than 180°, preferably between 190° and 225° and most preferably between 205° and 215°.

Figure 3:
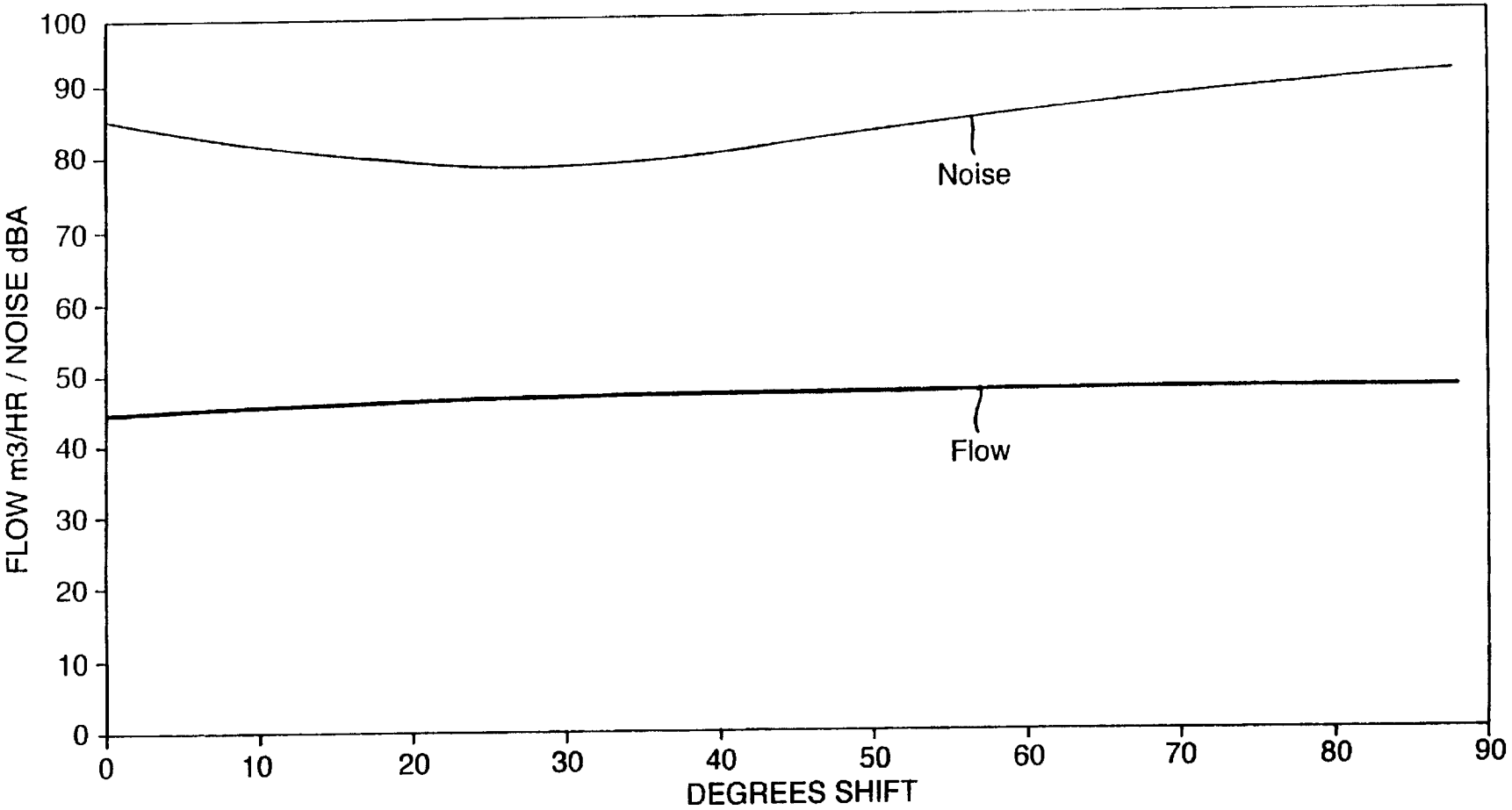
FIG. 3 is a graph demonstrating the change in flow rate and noise as the phase of the suction disc behind the pressure disc is altered.

Experiments have been carried on pumps modified in this way and the results are shown in FIG. 3. It will be noted that at the upper part of FIG. 3 the noise level is demonstrated depending on the degrees of shift from 180° out of phase. It will be seen that the noise level at exactly 180° out of phase (0° shift) is about 85 dBA, whereas when the shift is changed to between 25° and 35° there is a very marked reduction in the noise level down to 78 dBA. When the phase shift is increased above about 45° then the noise level gets back to 85 dBA and increases steadily.

At the same time it will be noted that there is a slight improvement in the flow rate so that at 0° shift (180° out of phase) there is a flow rate of about 45 $m^3$/hr whereas there is a steady increase so that between 25° and 35° shift (between 205° and 215° out of phase) the flow rate is increased to about 47 or 48 $m^3$/hr. There is, thereafter, in fact a slight increase to between 48 and 49 $m^3$/hr. However, at the higher levels, as mentioned above, there is a considerable increase in the noise to an unacceptable level.

It will be seen, therefore, that considerable advantages arise out of selecting the degree of shift to between 10° and 45° and more especially between 25° and 35° lag.

The method of achieving this can be one of several. For example keyways could be cut to provide the right amount of shift, the shaft and the collars could be provided with splines and the corrected positioning chosen, alternatively pins or grub screws could be provided to achieve this result.

Moreover, other methods of reciprocation can easily be envisaged by a man skilled in the art.

What is claimed is:

1. A dual disc pump comprising a housing having a pumping chamber therein, an inlet and an outlet to the pumping chamber, first and second seats formed in said pumping chamber at spaced locations, a suction pumping disc reciprocable into and out of engagement with said first seat, a pressure pumping disc reciprocable into and out of engagement with said second seat and means to reciprocate said pumping discs out of phase with one another, wherein the suction disc is phased to lag by more than 180° behind the pressure disc.

2. A pump according to claim 1, wherein the suction disc is phased to lag by between 190° and 225° behind the pressure disc.

3. A pump according to claim 2, wherein the suction disc is phased to lag by between 205° and 215° behind the pressure disc.

4. A pump according to claim 1, wherein the means to reciprocate said pumping discs include a drive shaft, first and second eccentrically mounted collars, connectable to said drive shaft, first and second bearings mounted to surround said collars, first and second drive rods, rotationally connected to said bearings, drive pins connecting the drive rods to the pumping discs and means rigidly to connect the collars to the drive shaft.

5. A pump according to claim 4, wherein the means to connect the collars to the drive shaft comprise keys and keyways, splines, pins or grub screws.

* * * * *